United States Patent [19]

Frerichs

[11] Patent Number: 4,859,097

[45] Date of Patent: Aug. 22, 1989

[54] RIBBON CARTRIDGE FOR TYPEWRITERS OR SIMILAR OFFICE MACHINES

[75] Inventor: Klaus-Dieter Frerichs, Schortens, Fed. Rep. of Germany

[73] Assignee: Olympia Werke AG, Fed. Rep. of Germany

[21] Appl. No.: 30,734

[22] Filed: Mar. 25, 1987

Related U.S. Application Data

[63] Continuation of Ser. No. 731,506, May 7, 1985, abandoned.

[30] Foreign Application Priority Data

May 18, 1984 [DE] Fed. Rep. of Germany ..... 3418545

[51] Int. Cl.[4] ..... B41J 32/00

[52] U.S. Cl. ..... 400/208; 400/693.1

[58] Field of Search ..... 400/144.2, 175, 194, 400/195, 196, 196.1, 207, 208, 208.1, 223, 228, 236, 242, 243, 674, 693.1; 242/197, 198, 199, 200; 206/387, 608, 611, 612, 620

[56] References Cited

U.S. PATENT DOCUMENTS

| | | | |
|---|---|---|---|
| 2,873,014 | 2/1959 | Lambert | 400/242 X |
| 3,151,723 | 10/1964 | Wendt | 400/207 |
| 3,228,582 | 1/1966 | Osberg | 206/608 |
| 3,612,774 | 10/1971 | Wiklund | 360/118 X |
| 3,877,561 | 4/1975 | Guerrini et al. | 400/235.1 X |
| 4,010,839 | 3/1977 | Guerrini et al. | 400/207 |
| 4,349,166 | 9/1982 | Tanaka et al. | 242/197 |

FOREIGN PATENT DOCUMENTS

| | | | |
|---|---|---|---|
| 0047375 | 3/1982 | European Pat. Off. . | |
| 2553329 | 5/1976 | Fed. Rep. of Germany . | |
| 2038288 | 7/1980 | United Kingdom | 206/612 |

OTHER PUBLICATIONS

IBM Technical Disclosure Bulletin, vol. 25, No. 4, Sep. 1982, pp. 1944–1945, "Protective Carton", by Dunning et al.

*Primary Examiner*—Charles Pearson

*Attorney, Agent, or Firm*—Wood, Herron & Evans

[57] ABSTRACT

A ribbon cartridge is disclosed for typewriters and similar office machines which require frequent changes of the ribbon. The ribbon cartridge includes a tub-shaped base and cover and an integral sealing member by means of which the openings in the ribbon cartridge can be hermetically sealed for shipping and storage and which is easily removable prior to insertion in the holding device of the office machine.

9 Claims, 2 Drawing Sheets

RIBBON CARTRIDGE FOR TYPEWRITERS OR SIMILAR OFFICE MACHINES

This is a continuation of application Ser. No. 731,506, filed May 7, 1985, now abandoned.

BACKGROUND OF THE INVENTION

The invention concerns a ribbon cartridge for typewriters or similar office machines of the type in which the ribbon runs outside the cartridge through an exit and entrance opening in the side wall and is moved by a drive wheel which is rotatably mounted in the cartridge and engages a drive member arranged in a cartridge-holding device of the machine.

Many ribbon cartridges with various types of ribbon are previously known which avoid soiling one's fingers when inserting or removing the cartridges from the cartridge holder of the machine and which enable an easy replacement. Previously known from the German patent disclosure No. 25 53 329 is a carbon ribbon cartridge which can be changed with one hand. But this prior cartridge still comprises many components which are less suited for inexpensive mass production. Besides, the cartridge requires a separate container for shipping and storage.

Also known from the European patent disclosure No. 0 047 375 is a ribbon cartridge where the casing is formed by a foldable piece of cardboard. The take-off and take-up reels for the ribbon are rotatably mounted in recesses in the bottom and cover parts. To ensure a smooth feeding of the ribbon, the cardboard requires accurate manufacture. A special packing is required here, too, for shipping and storage.

The problem underlying the invention is to provide a ribbon cartridge including packing which consists of components which are simple and require little material and can be installed easily on the holder of the machine and removed from it with one hand and without requiring any dexterity of the person operating the machine. Additionally, the ribbon cartridge is to be suited for inexpensive mass-produced machines for the home market.

SUMMARY OF THE INVENTION

The present invention is predicated upon the concept of providing a ribbon cartridge comprising a base and a cover plate adapted to enclose a take-off and a supply reel for a ribbon, the cartridge having an exit and entrance opening in a side wall for permitting the ribbon to run outside the cartridge and a sealing member which, for shipping and storage, hermetically seals the cartridge and can be removed prior to insertion of the cartridge in a holder of an office machine.

The ribbon cartridge of the present invention is advantageous in that it consists of simple, material-saving components, and no special packing is required for storage and shipping. The cartridge casing serves likewise as packing. Besides, the installation of the bearing and drive components in the cartridge is simplified to the extent such that their installation can be handled by an automatic device.

These and other objects and advantages of the present invention will be more readily apparent from a consideration of the following detailed description of the drawings.

DESCRIPTION OF A PREFERRED EMBODIMENT

Figure 1:
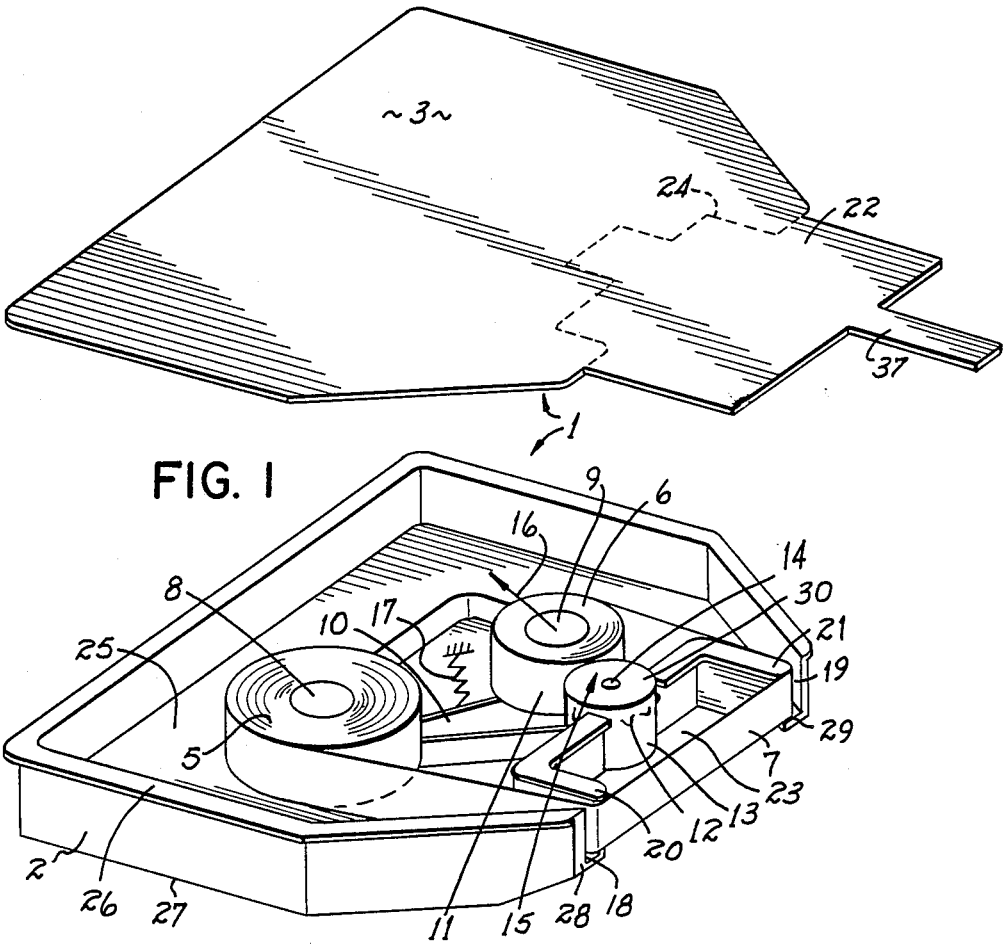
FIG. 1 shows a perspective view of a ribbon cartridge of the present invention prior to connecting the cover with the bottom part.
Figure 2:
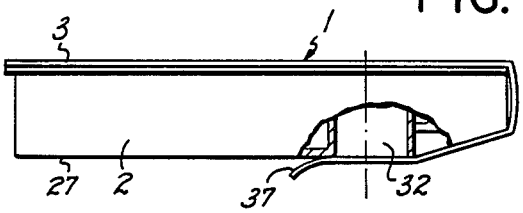
FIG. 2 is a side view of the sealed ribbon cartridge.
Figure 3:
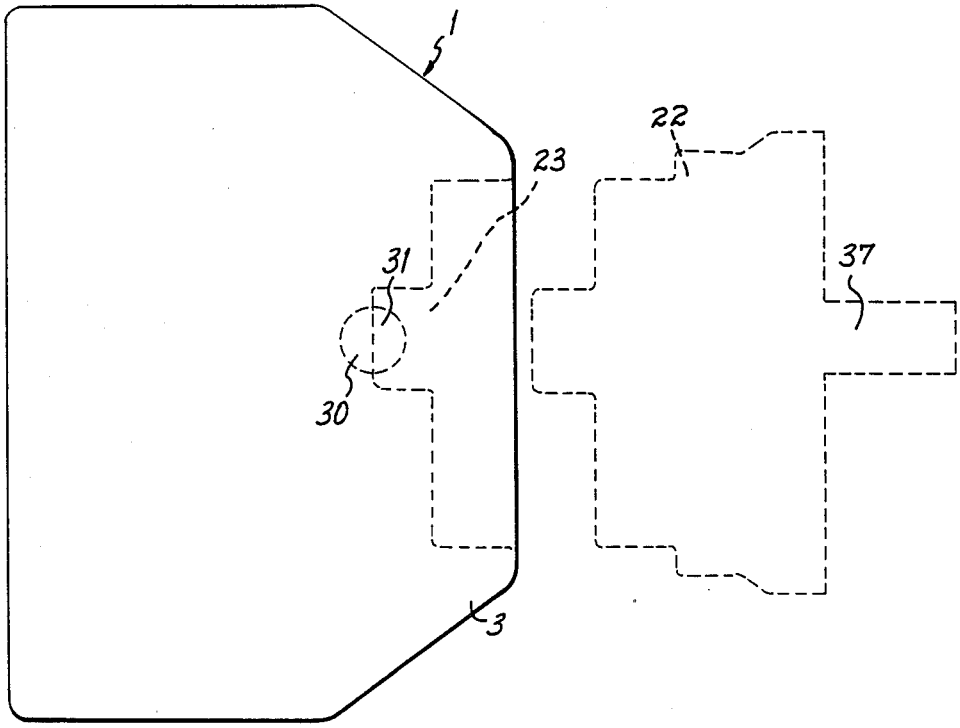
FIG. 3 is a plan view of the ribbon cartridge with the sealing component separated.

Illustrated in FIGS. 1 through 3 is a ribbon cartridge 1 consisting of a tub-type base 2 and a cover plate 3 connectable with it. The ribbon cartridge 1 is separately connected with a support plate 4 of a typewriter or similar office machine, through suitable mounting means (not shown). These are customarily so designed that the ribbon cartridge 1 can be conveniently installed on the support plate 4, with only one hand. According to FIG. 1, a take-off reel 5 and a take-up reel 6 for a ribbon 7 are rotatably mounted in the tub-shaped base 2. The take-off reel 5 rotates about a fixed pin 8 while the take-up reel 6 is rotatably mounted on a pin 9 which is arranged, fixed, on a bearing lever 10 which is spring-loaded and swivels coaxially about the pin 8. The outer surface of the ribbon coil 11 on the take-up reel 6 is in mesh with spikes 12 of a drivable spiked feed roll 13 in a fashion such that, as the spiked feed roll 13 turns about a pin 14 in the direction of arrow 15, the take-up reel 6 is positively rotated. As the take-up reel 6 increases in diameter, it swivels with the bearing lever 10 about the pin 8 in the direction of arrow 6. The drive of the take-up reel 6 is ensured in that the bearing lever 10 is spring-loaded by a spring 17 acting opposite to the direction of arrow 16. The ribbon 7 runs through an exit opening 18 and an entrance opening 19 in a side wall outside the ribbon cartridge 1, the exit and entrance opening 18 and 19, respectively, being provided in guide arms 20, 21 which are permanently connected with the base 2. The free ends of the guide arms 20, 21 hold the ribbon 7 between a type carrier, for instance, a print wheel, and the respective printing location on a printing medium, which is not shown.

Connected with the cover plate 3 is a sealing section 22 which makes it possible to hermetically seal all openings of the ribbon cartridge 1 including the recess 23 between the guide arms 20, 21 in a fashion such that the ribbon section protruding out of the casing of the ribbon cartridge 1 will be protected for shipping and storage. Prior to installing the ribbon cartridge 1 on the support plate 4 of the machine, the sealing section 22 is removed from the cover plate 3, and thus from the original cartridge 1, along a parting line 24. The parting line 24 between the sealing part 22 and the cover plate 3 may be perforated. The parting line may also have a different design within the scope of the invention.

The tub-shaped base 2 with the storage chamber 25 for the take-off reel 5 and the take-up reel 6 is provided along its rim an outward flange 26 for connection with the cover plate 3 and around the exit and entrance openings 18 and 19, respectively, and, on its underside 27, bearing and/or connecting surfaces 28, 29 for the sealing component 22. The cover plate 3 with the sealing component 22 is connected, for instance, by means of a heat-sealing adhesive or other customary joint, with the base component.

The spiked feed roll 13 connects with a knurled wheel 30 which can be rotated with the fingers and protrudes with a circumferential section according to FIG. 3 into the recess 23. This enables a tensioning of the ribbon 7 by hand at any time. Disposing the knurled wheel 30 in the recess 23 which can be closed by the sealing component 22 leaves the surface of the cover plate 3 free of any raised elements, making it possible to give it a flat design. This favors stacking several ribbon cartridges 1 to form a packaging unit.

The tub-shaped base 2 may consist of a deep-drawn or injection-molded component which can be produced from inexpensive materials. Together with the flat cover plate 3 and the sealing part 22, this base 2 forms a blister pack such as used already in other technical areas. The cover plate 3 consists preferably of cardboard material and contains data about the ribbon type contained in the cartridge 1 and its application.

Figure 4:
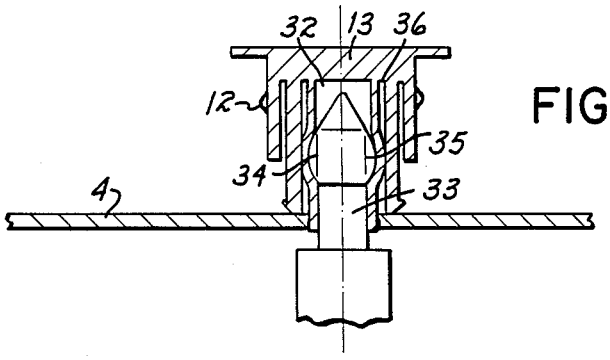
FIG. 4 is a vertical cross-sectional view through the feed roll with the drive wheel in coupled condition.

A distinguishing feature of the ribbon cartridge 1 is that its casing serves likewise as packing. The openings required for using the cartridge 1 in the machine are exposed in a simple manner by removal of the sealing component 22. Exposed thereby is also an opening 32 in the spiked feed roll 13 for insertion of a spindle 33 extending through the support plate 4. This spindle 33 features knife-like lugs 34, 35 which can be coupled positively with an elastically deformable ring 36 in the spiked feed roll 13; refer to FIG. 4. This ensures always a dependable coupling of the spiked feed roll 13 with the spindle 33 which can be driven by a stepping motor. The removal and/or separation of the sealing component 22 from the ribbon cartridge 1 is facilitated by a tab 37 which can be grabbed with the fingers. According to FIG. 2, the free end of this tab protrudes somewhat beyond the underside 27 of the ribbon cartridge 1, in a way such that the tab 37 can be grabbed easily with the fingers. As the sealing part 22 is separated from the ribbon cartridge 1, the opening 32 is exposed first, and thereafter the recess 23, followed by finally separating the sealing component through the perforated parting line 24 from the cover plate 3. Next, the ribbon cartridge 1 can be installed conveniently on the support plate 4.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims.

Having described my invention, I claim:

1. A ribbon cartridge for typewriters or similar office machines having a cartridge-holding device, said cartridge enclosing a ribbon and including a first wall and a side wall having exit and entrance openings through which the ribbon runs outside the cartridge, said cartridge further comprising:

a drive wheel rotatably mounted within the cartridge, said drive wheel being adapted to be coupled through an opening in the cartridge to a drive element of said cartridge-holding device, said first wall overlying said side wall and enclosing said drive wheel and the portion of said ribbon disposed within said cartridge, and a sealing member formed integral with said cartridge and being connected to said first wall along a parting line, said sealing number extending from said first wall to a position overlapping said side wall and overlying and enclosing said exit and entrance openings and the portion of said ribbon outside said cartridge, said sealing member hermetically sealing said cartridge and being removable prior to insertion of said cartridge in said cartridge holder.

2. The cartridge of claim 1 in which said parting line is perforated.

3. The cartridge of claim 1 in which said sealing member includes a tab which can be grasped for separating the sealing member from the cartridge.

4. The cartridge of claim 1 in which said cartridge includes a tub-shaped base, said base being configurated to form a storage chamber for said ribbon and said drive wheel, guide arms carried by said tub-shaped base, the outer ends of said guide arms being spaced from the side wall of said tub and defining said exit and entrance openings, and said first wall comprising a flat cover plate joined to said tub-shaped base, said cover plate being connected to said sealing member along said parting line.

5. The cartridge of claim 4 in which said ribbon is supported between the free ends of said guide arms, whereby when said cartridge is mounted in said cartridge-holding device the ribbon is located between a type carrier and a printing location on a printing medium, said tub-shaped base having an outwardly extending flange formed along the edge of its side wall, said flange being in abutment with said cover plate, said tub-shaped base further including a bottom wall and bearing surfaces adjacent said entrance and exit openings and on its bottom wall in engagement with said sealing member.

6. The cartridge of claim 5 in which said cover plate and sealing member are connected to said tub-shaped base through an adhesive joint.

7. The cartridge of claim 6 further comprising a take-off reel and a take-up reel, said drive wheel being spiked and being disposed for engagement with the ribbon wound on said take-up reel, a knurled wheel connected to said drive wheel for manually turning said feed roll, said knurled wheel protruding into a recess between said guide arms, whereby said knurled wheel can be enclosed and sealed by said sealing member.

8. The cartridge of claim 4 in which said tub-shaped base is formed of a thin-walled, deep-drawn member forming a blister pack with said flat cover plate.

9. The cartridge of claim 4 in which said tub-shaped base is formed of a injection molding member forming a blister pack with said flat cover plate.

* * * * *